US010377029B2

(12) United States Patent
Moore

(10) Patent No.: US 10,377,029 B2
(45) Date of Patent: Aug. 13, 2019

(54) HAMMER SIDEPLATE TIGHTENING MECHANISM

(71) Applicant: Caterpillar Inc., Peoria, IL (US)

(72) Inventor: Cody Moore, Waco, TX (US)

(73) Assignee: Caterpillar Inc., Deerfield, IL (US)

( * ) Notice: Subject to any disclaimer, the term of this patent is extended or adjusted under 35 U.S.C. 154(b) by 357 days.

(21) Appl. No.: 15/345,654

(22) Filed: Nov. 8, 2016

(65) Prior Publication Data

US 2018/0126536 A1 May 10, 2018

(51) Int. Cl.
*B25D 17/08* (2006.01)
*B25D 17/00* (2006.01)
*E02F 3/96* (2006.01)

(52) U.S. Cl.
CPC ..... *B25D 17/08* (2013.01); *B25D 17/00* (2013.01); *E02F 3/966* (2013.01); *B25D 2250/051* (2013.01); *B25D 2250/105* (2013.01); *B25D 2250/121* (2013.01)

(58) Field of Classification Search
CPC .. B25D 17/08; B25D 17/00; B25D 2250/051; B25D 2250/121; B25D 2250/105; E02F 3/966; F16B 5/0225; F16B 5/0621; F16B 5/065; F16B 7/06
USPC ..... 403/168, 43, 44
See application file for complete search history.

(56) References Cited

U.S. PATENT DOCUMENTS 1,681,381 A * 8/1928 Tolman, Jr. ..... B65G 53/521 285/125.1
2,600,959 A * 6/1952 Bender ..... B60D 1/52 280/498
3,278,210 A * 10/1966 Sanders ..... F16B 7/06 254/232
3,714,866 A * 2/1973 Ottestad ..... E02F 3/966 91/216 R
3,743,330 A * 7/1973 Itatani ..... F16B 7/06 29/463
3,757,875 A * 9/1973 Gunning ..... B25D 17/12 173/44
3,851,978 A * 12/1974 Kuipers ..... F16B 7/06 403/45
4,018,135 A * 4/1977 Lance ..... B25D 9/20 91/276
4,786,201 A * 11/1988 Huetter ..... F16B 12/14 403/22

(Continued)

FOREIGN PATENT DOCUMENTS

EP 0541860 A1 * 5/1993 ..... E04G 17/0658

OTHER PUBLICATIONS

The Steel Supply Company, Inc., "Turnbuckle and Clevis Rods : One Left Hand Thread Per Rod", Web page, published on the internet on Feb. 3, 2016, USA.

*Primary Examiner* — Alexander M Valvis
*Assistant Examiner* — Thomas M Wittenschlaeger
(74) *Attorney, Agent, or Firm* — Law Office of Kurt J. Fugman LLC

(57) ABSTRACT

A method for tightening or loosening components of a hammer assembly is comprises inserting a tool into an aperture defined by at least one component of the hammer assembly in order to engage the drive structure of a tensioning member, moving the drive structure of the tensioning member, and moving at least one draw member operatively associated with the tensioning member.

4 Claims, 7 Drawing Sheets

(56) References Cited

U.S. PATENT DOCUMENTS

| | | | | |
|---|---|---|---|---|
| 4,858,701 | A * | 8/1989 | Weyer | B25D 17/32 173/50 |
| 5,713,686 | A * | 2/1998 | Maughan | F16B 7/06 403/274 |
| 6,263,572 | B1 * | 7/2001 | Hattan | B23P 15/00 29/416 |
| 8,733,468 | B2 | 5/2014 | Teipel et al. | |
| 9,127,442 | B1 * | 9/2015 | Underwood | E02F 3/964 |
| 2002/0162251 | A1 * | 11/2002 | Underwood | E02F 3/964 37/403 |
| 2004/0244234 | A1 * | 12/2004 | Underwood | E02F 3/964 37/403 |
| 2012/0067606 | A1 * | 3/2012 | Lee | B28D 1/26 173/201 |
| 2013/0277514 | A1 * | 10/2013 | Mitrovic | F16B 12/30 248/222.51 |
| 2014/0332244 | A1 * | 11/2014 | Moore | E02F 3/966 173/90 |
| 2015/0041168 | A1 * | 2/2015 | Dostinov | B25D 17/20 173/90 |
| 2015/0175200 | A1 * | 6/2015 | Seibert | B62D 7/20 280/93.51 |
| 2015/0360361 | A1 | 12/2015 | Gunasekaran et al. | |
| 2016/0067858 | A1 | 3/2016 | Moore | |

* cited by examiner

HAMMER SIDEPLATE TIGHTENING MECHANISM

TECHNICAL FIELD

The present disclosure relates to hydraulic hammers assemblies that have rigid mount sideplates that are used to mount the powercell of the hammer assembly to the host machine. Specifically, the present disclosure relates to hydraulic hammer assemblies that use specially designed mounting and tightening mechanism for attaching the power cell to the sideplates.

BACKGROUND

FIG. 1 illustrates an exemplary disclosed machine 10 having a hydraulic hammer assembly 12. Machine 10 may be configured to perform work associated with a particular industry such as, for example, mining or construction. Machine 10 may be a backhoe loader (shown in FIG. 1), an excavator, tool carrier, a skid steer loader, or any other type of machine. Hammer assembly 12 may be pivotally connected to machine 10 through a boom 14 and a stick 16. Alternatively, hammer assembly 12 may be connected to machine 10 in another way.

Machine 10 may include a hydraulic supply system (not shown in FIG. 1) for moving and powering hammer assembly 12. For example, machine 10 may include a pump (not shown) connected through one or more hydraulic supply lines (not shown) to hydraulic cylinders 18 associated with boom 14 and stick 16, and to hammer assembly 12. The hydraulic supply system may supply pressurized fluid, for example oil, from the pump to the hydraulic cylinders 18 and hammer assembly 12. Hydraulic cylinders 18 may raise, lower, and/or swing boom 14 and stick 16 to correspondingly raise, lower, and/or swing hammer assembly 12. Operator controls for movement of hydraulic cylinders 18 and/or hammer assembly 12 may be located within a cab 20 of machine 10.

As shown in FIG. 1, hammer assembly 12 may include a housing 22, which may be connected to stick 16. A work tool 24 may be operatively connected to an end of housing 22 opposite stick 16. It is contemplated that work tool 24 may include any tool capable of interacting with hammer assembly 12. For example, work tool 24 may include a chisel bit, moil point, percussion buster, blunt tool, ramming tool, tamping plate, cutter, or other hammer bit. Although not shown, a reciprocating piston may be powered hydraulically to move the hammer bit up and down. The hammer assembly 12 is shown to be attached to a coupling mechanism 28 via an adapter plate 30 and fasteners 32.

As best seen with reference to FIGS. 2 thru 4, the housing 22 contains the powercell 34. More particularly, the powercell 34 is attached to the rigid mount sideplates 36 of the housing 22 via fasteners 38 that mate with the outer counterbores 40 of the sideplates 36 and are threaded into the side holes 42 of the mounting plates 44 of the powercell 34. It may be noted that the top ends of the sideplates 36 include attachment portions 46 that define holes 48 that can receive or otherwise mate with fasteners 30 (shown in FIG. 1) for attaching the housing 22 of the hammer assembly 12 to the adapter plate 30 (also shown in FIG. 1) of the machine 10.

As can be imagined, the heads of the fasteners can become damaged from contact with rocks or other debris as the hammer is being used, making them difficult to remove when it is later desired to disassembly the hammer assembly for maintenance, etc. In some cases, the heads of the fasteners need to be ground or the shanks of the fasteners need to be cut to facilitate disassembly. Accordingly, it is desirable to provide a mechanism that allows the hammer assembly to be assembled and disassembled without needing to resort to such time consuming measures.

SUMMARY

A tightening mechanism is provided comprising a first draw member including a flange and a shaft defining left handed internal threads, a second draw member including a flange and a shaft defining right handed internal threads, and a tensioning member including a first end portion including right handed external threads, a second end portion including left handed threads and a center drive portion.

A hammer assembly is provided comprising a first sideplate defining a first side aperture, a second sideplate defining a second side aperture, a powercell assembly disposed between the first sideplate and the second sideplate defining a bore extending through the assembly that is in communication with the first and second side aperture, the assembly also defining an access aperture that is in communication with the bore, and a tightening mechanism operationally associated with the first and second sideplates, said mechanism being configured to tighten or loosen the sideplates around the powercell, the mechanism being disposed in the bore of the powercell assembly.

A method for tightening or loosening components of a hammer assembly is provided comprising inserting a tool into an aperture defined by at least one component of the hammer assembly in order to engage the drive structure of a tensioning member, moving the drive structure of the tensioning member, and moving at least one draw member operatively associated with the tensioning member.

BRIEF DESCRIPTION OF THE DRAWINGS

The accompanying drawings, which are incorporated in and constitute a part of this specification, illustrate several embodiments of the disclosure and together with the description, serve to explain the principles of the disclosure. In the drawings.

DETAILED DESCRIPTION

Figure 1:
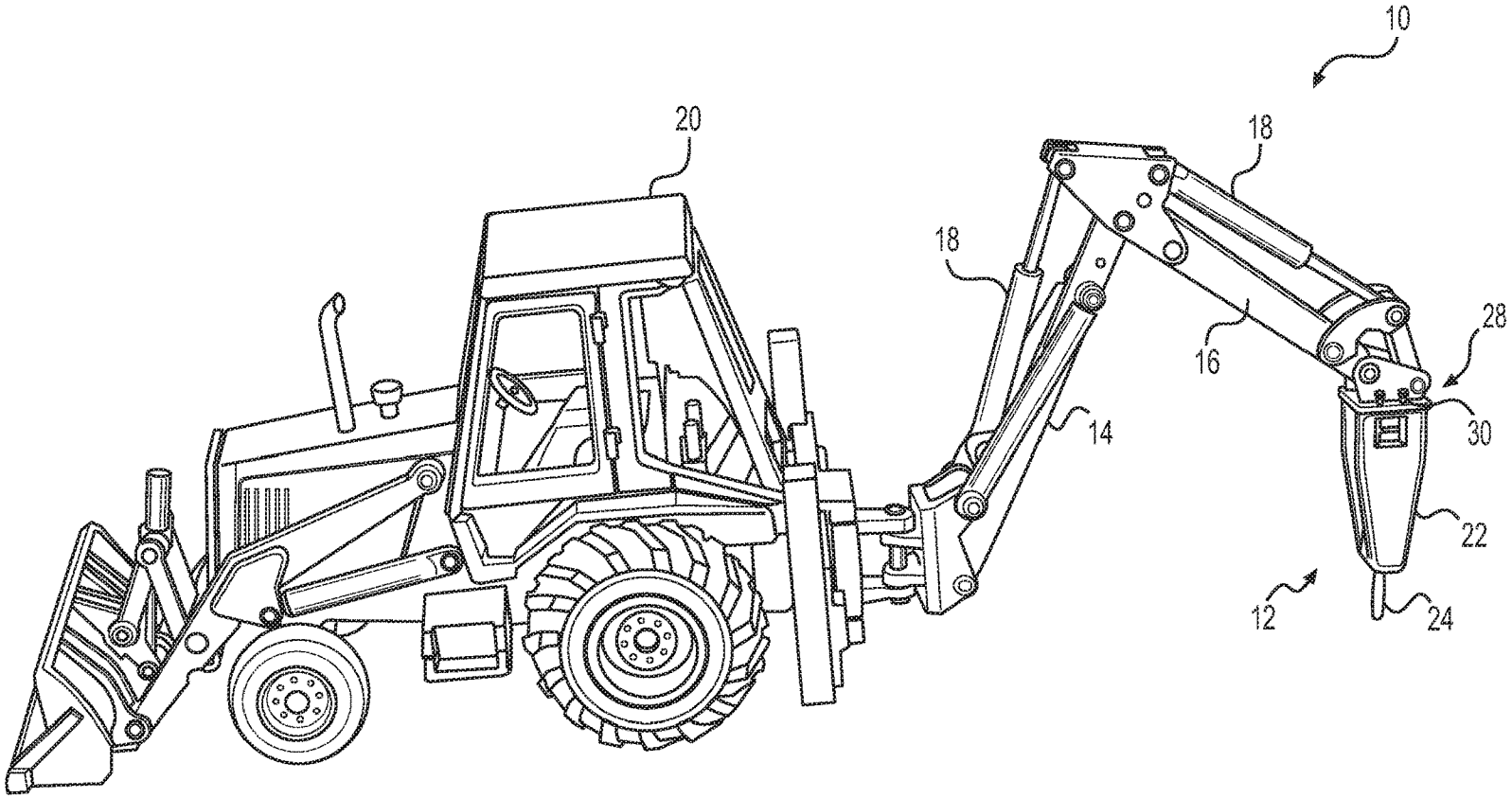
FIG. 1 PRIOR ART
FIG. 1 is a perspective view of a machine using a hammer assembly with a hammer bit in a manner known in the art.
Figure 2:
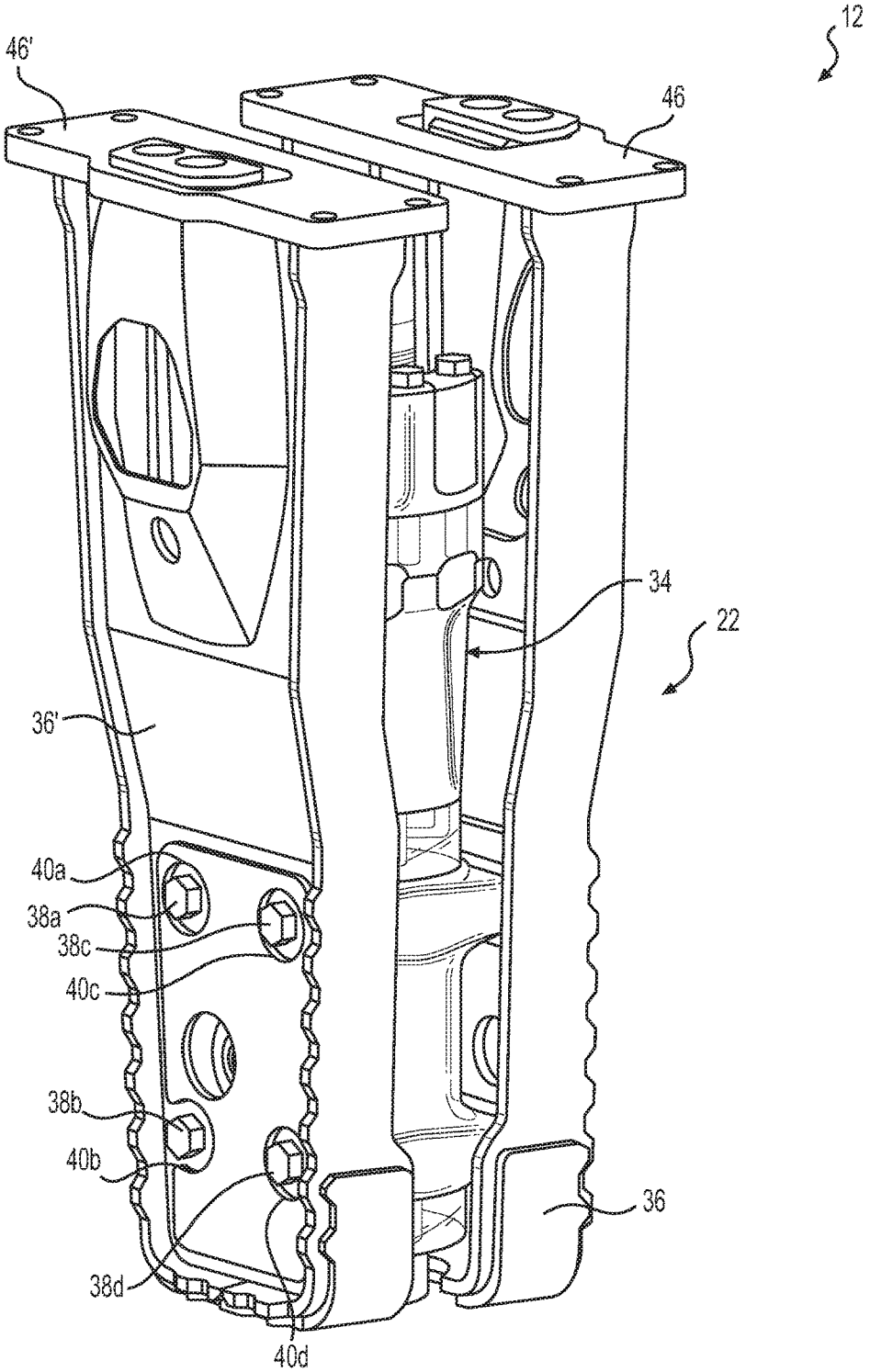
FIG. 2 PRIOR ART
FIG. 2 is a perspective view of hammer assembly of FIG. 1 removed from the machine and its stick and boom, showing fasteners mating with the left sideplate that hold the hammer assembly together.
Figure 3:
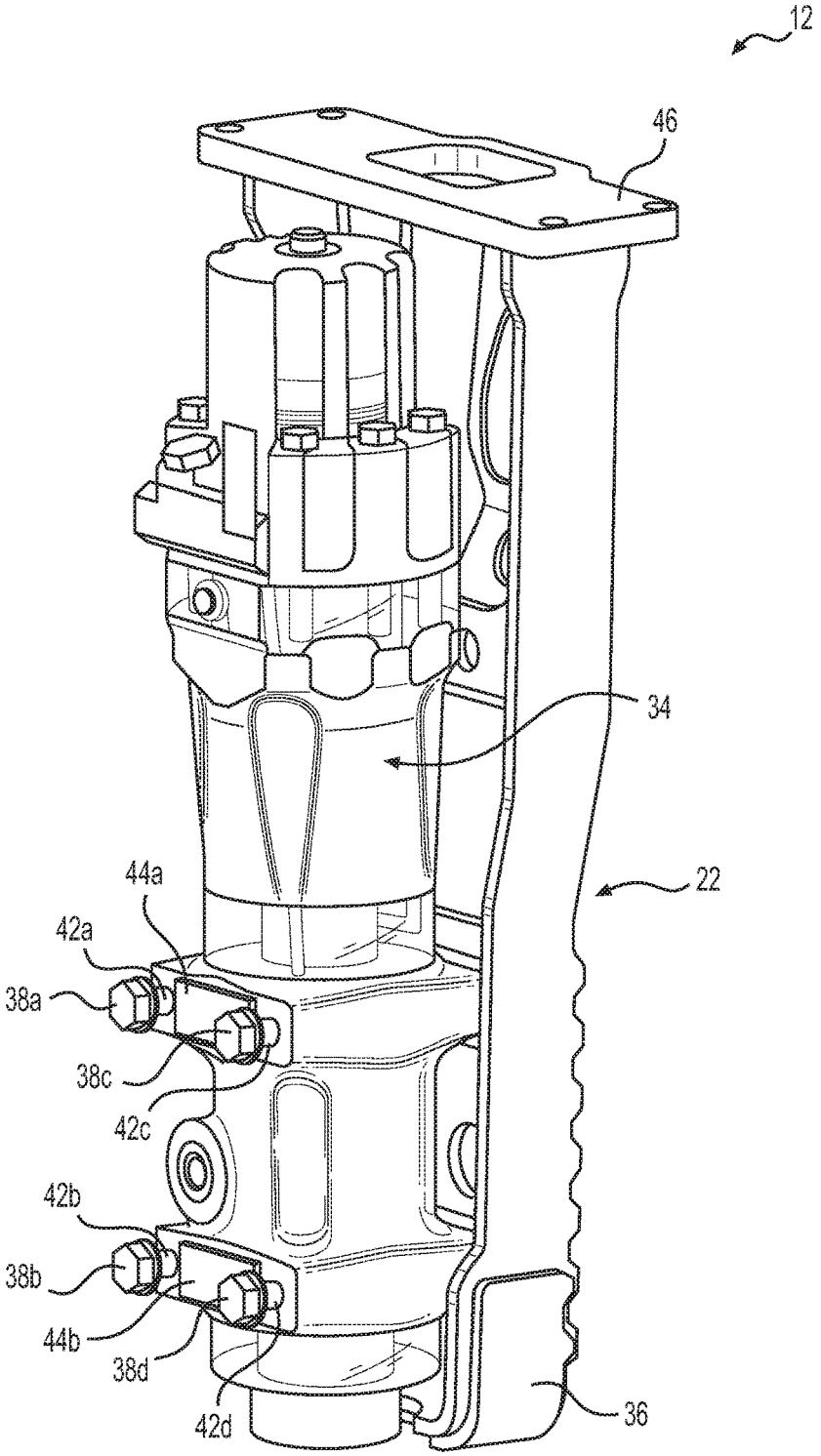
FIG. 3 PRIOR ART
FIG. 3 is a perspective view of the hammer assembly of FIG. 2 with the left sideplate removed, revealing the powercell of the hammer assembly and showing the fasteners mating with the mounting plates of the powercell.
Figure 4:
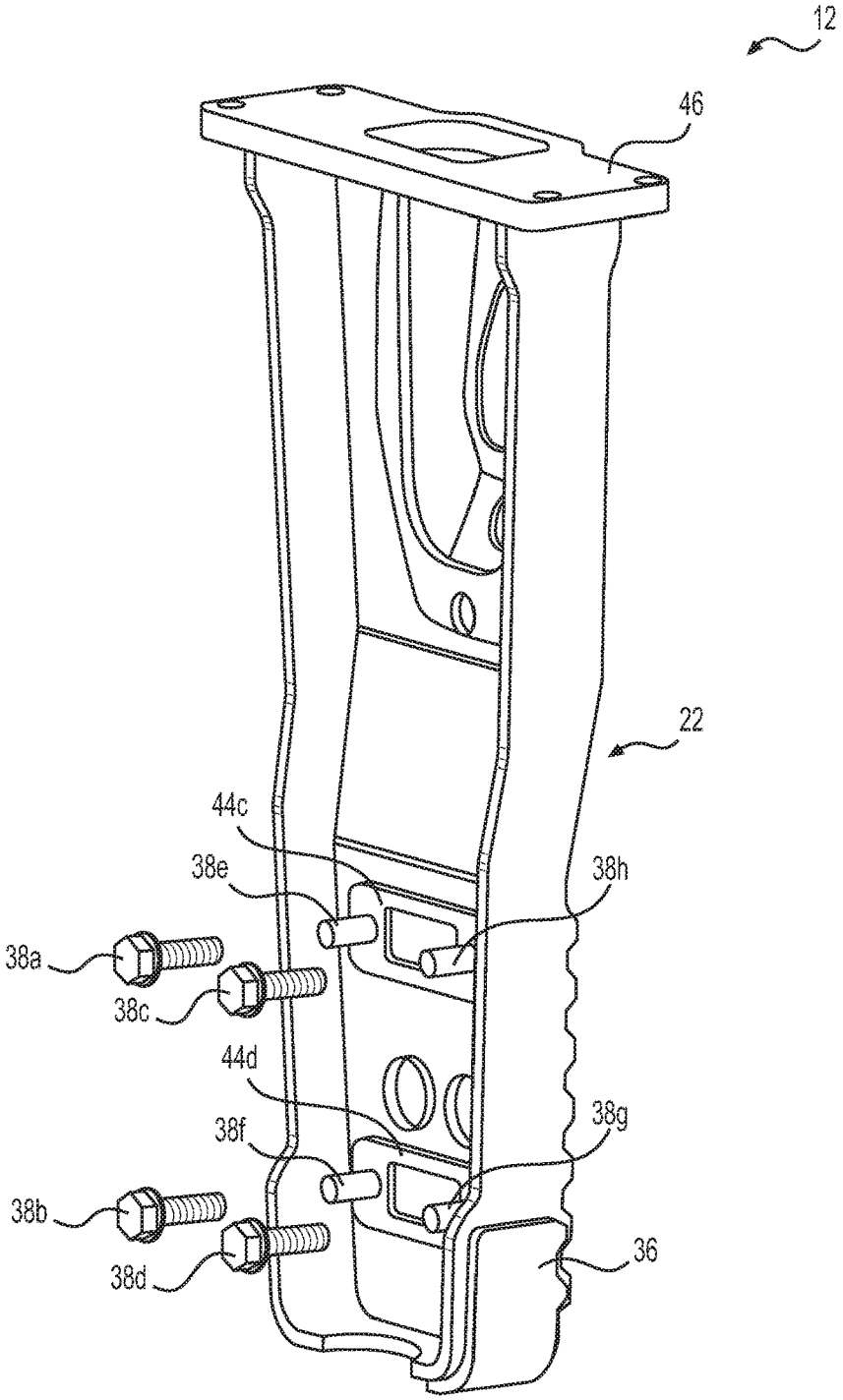
FIG. 4 PRIOR ART
FIG. 4 illustrates the hammer assembly of FIG. 3 with the powercell removed, exposing the shanks of additional fasteners used to mount the right sideplate to the powercell in a similar manner as the left sideplate is mounted to the powercell.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100*a*, 100*b* etc. It is to be understood that the use of letters immediately after a reference number indicates that these features are similarly shaped and have similar function as is often the case when geometry is mirrored about a plane of symmetry. For ease of explanation in this specification, letters will often not be included herein but may be shown in the drawings to indicate duplications of features discussed within this written specification.

Various embodiments of a tightening mechanism for loosening or tightening components of a hammer assembly, such as the sidepates of the assembly will now be described. A tensioning member with a drive structure may be disposed inside the hammer assembly, protecting the mechanism. The tensioning device may couple with one or more draw members that have flanges with a diminished profile that are external to the hammer assembly, making the flanges less susceptible to wear or damage as compared to the heads of fasteners currently used to assemble or disassemble a hammer assembly. Later herein, a method for using various embodiments of the tightening mechanism will be explained.

Figure 5:
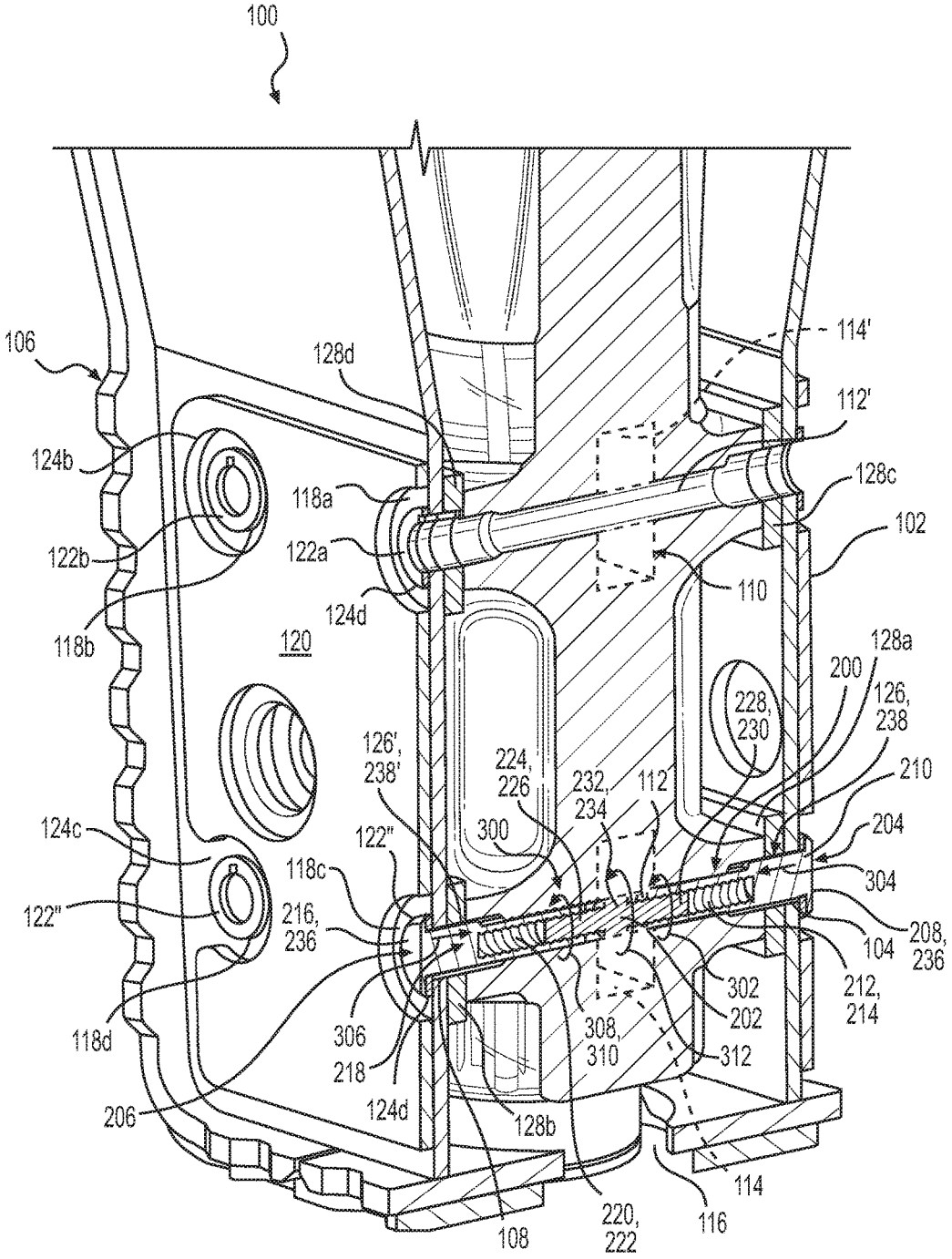
FIG. 5 is a perspective sectional view of a hammer assembly employing a mechanism according to an embodiment of the present disclosure for tightening or loosening the sideplates of the hammer assembly.

Beginning with FIG. 5, a hammer assembly 100, which may use a tightening mechanism 200 according to an embodiment of the present disclosure, is illustrated. The hammer assembly 100 may comprise a first sideplate 102 defining a first side aperture 104, a second sideplate 106 defining a second side aperture 108, and a powercell assembly 110 disposed between the first sideplate 102 and the second sideplate 106 defining a bore 112 extending through the assembly 110 that is in communication with the first and second side apertures 104, 108. The assembly 110 may also define an access aperture 114 that is in communication with the bore 112 and may also include a tightening mechanism 200 disposed in the bore 112 of the assembly 110 and that is operationally associated with the first and second sideplates 102, 106.

This mechanism 200 may be configured to tighten or loosen the sideplates 102, 106 around the powercell 110. The access aperture 114 may extend out of the side of the hammer assembly 100 to the slot 116 defined by the gap between the two sideplates 102, 106, allowing the insertion of a wrench or other tool that may engage the tensioning member 202 of the mechanism for tightening or loosening the mechanism 200.

Looking more closely at the tightening mechanism 200 of FIG. 5, the tightening mechanism 200 includes a first draw member 204, a second draw member 206 and a tensioning member 202 interfacing with the first draw member 204 and the second draw member 206. The first draw member 204 includes a flange 208 and a shaft 210 defining a first aperture 212 and includes left handed internal threads 214 disposed in the first aperture 212. Similarly, the second draw member 206 includes a flange 216 and a shaft 218 defining a second aperture 220 and includes right handed internal threads 222 disposed in the second aperture 220. The tensioning member 202 includes a first end portion 224 including right handed external threads 226 mating with the right handed internal threads 222 of the second aperture 220 of the shaft 218 of the second draw member 206, a second end portion 228 including left handed external threads 230 mating with the left handed internal threads 230 of the first aperture 212 of the first draw member 204, and a center drive portion 232 disposed between the first and second end portions 224, 228 being positioned in the access aperture 114 for the reasons just described above.

In some embodiments, the center drive portion 232 may include a hexagonal drive structure 234. In addition, the flange 208 of the first draw member 204 and the flange 216 of the second draw member 206 are flat plate portions 236, minimizing their profile as they extend slightly from the sideplates 102, 106, external of the hammer assembly 100. Thus, the risk of damaging or wearing these flat washer portions is reduced compared to the heads of fasteners that have been used in the past. More specifically, the flanges 208, 216 are disposed in counterbores 118 and are flush to recessed compared to the side surfaces 120 of the sideplates 102, 106, which provides protection to the flanges 208, 216. In some cases, washers 122 may be provided between the bottom surface 124 of the counterbore 118 and the flange 208, 216 to provide a proper bearing surface. These washers may be omitted in other embodiments. Four instances of identically configured apertures/bores and associated tightening mechanisms are shown to be possibly used for the hammer assembly of FIG. 5. It is contemplated that different numbers of mechanisms, apertures/bores and configurations may be used in other embodiments.

In some embodiments, the friction generated between the flanges 208, 216 and the sideplates 102, 106 is sufficient to prevent a draw member 204, 206 from rotating as the drive structure 234 of the tensioning member 202 is rotated. As long as the draw member 204, 206 does not rotate, then rotation of the tensioning member 202 is desirably converted into an inward or outward translation of the draw member 204, 206. In some embodiments, it is desirable to provide a more reliable way to keep the draw members 204, 206 from rotating, helping to ensure that the draw members 204, 206 translate. For example, at least one of the bore 112, first side aperture 104 and second side aperture 108 may define a first anti-rotation feature 126 and at least one of the flange 208 of the first draw member 204, the flange 216 of the second draw member 206, the shaft 210 of the first draw member 204 and the shaft 218 of the second draw member 206 includes a second anti-rotation feature 238 mating with the first anti-rotation feature 126.

As shown in FIG. 5, the anti-rotation feature 126 of the power cell assembly 110, sideplate 102, 106, mounting plate 128, etc. may take the form of a keyway while the anti-rotation feature 238 of a draw member 204, 206 may take the form of a key (see also FIG. 6) that is complimentarily shaped to be received in the keyway. Hence, any rotation of the tensioning member 202 is not imparted to the draw member 204,206. Instead, the draw member 204, 206 is forced to translate either inwardly, tightening the sideplates 102, 106 about the powercell 110, when the tensioning member 202 is rotated in a first direction, or outwardly, loosening the sideplates 102, 106 about the powercell 110, when the tensioning member 202 is rotated in the opposite direction.

In many embodiments, the first end portion 224, drive portion 232 and second end portion 228 of the tensioning member 202 are integrally formed as part of a single component. Also, as alluded to earlier, and the first sideplate 102 and the second sideplate 106 may define a slot 116 therebetween, and the center drive portion 232 is disposed in the slot 116. More specifically, the slot 116 may be in communication with the access aperture 114, allowing a user to reach the drive portion 232 of the tensioning member 202 with a tool such as a wrench for rotating the drive portion 232, effectuating the tightening or the loosening of the mechanism 200. For this embodiment, the first and second draw members 204, 206 are identically externally configured (internal threads 214, 222 in apertures 212, 220 may be different) but this may not be the case for other embodiments. It is also contemplated that one of the draw members 204, 206 may be integrally formed with the tensioning member 202 in other embodiments.

Figure 6:
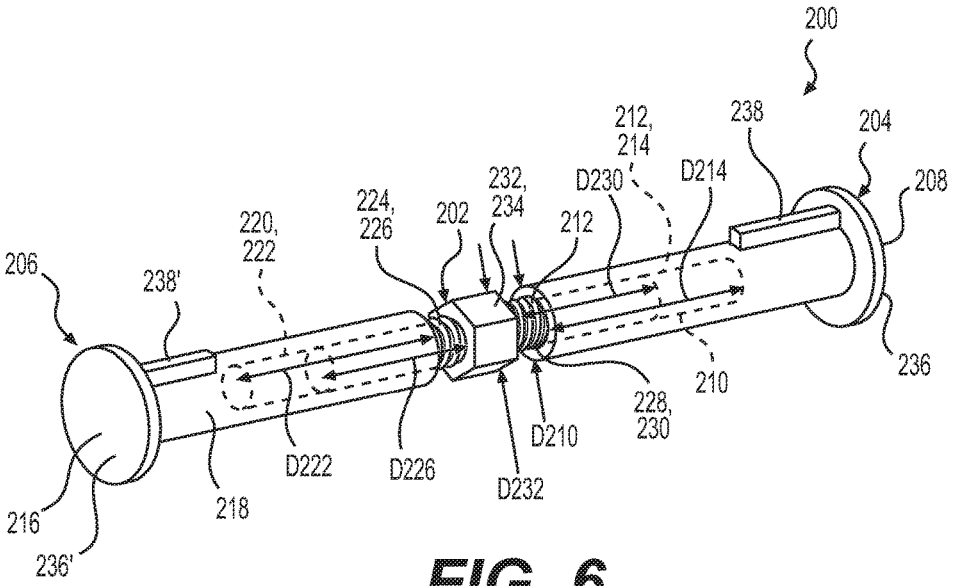
FIG. 6 is a perspective view of the mechanism for tightening or loosening the sideplates of the hammer assembly of FIG. 5 shown in isolation from the hammer assembly.

With continued reference to FIG. 5, the mechanism 200 may be assembled into the hammer assembly 100 using a method 300 as follows. First, a tensioning member 202 may be threaded or otherwise attached to a draw member 204 (step 302). In some cases, this means that the tensioning member 202 has been integrally formed with the draw member 204. Second, the tensioning member 202 and draw member 204 are inserted into a side aperture 104 and the bore 112 until the flange 208 contacts the side surface of a sideplate 102 and the drive portion 232 is disposed in the access aperture 114 (step 304). As best seen in FIG. 6, this may be accomplished since the maximum dimension D232 of the drive portion 232 is less than or equal to the diameter D210 of the shaft 210 of the draw member 204. Allowing, these parts of the mechanism 200 to fit within the side aperture 104 and bore 112 of the sideplate 102 and the powercell 110, etc. Third, the other draw member 206 is inserted into the other side aperture 108 and into the bore 112 until the draw member 206 makes contact with an end portion 224 of the tensioning member 202 (step 306). The draw member 206 is then rotated, threading the draw member 206 onto the tensioning member 202 (step 308).

This continues until either one of two things happen. In cases where no anti-rotation features are provided, the draw member is threaded onto the tensioning member using the flange until the flange of the draw member contacts the other sideplate. In situations where anti-rotation features are provided, the draw member is threaded until the anti-rotation feature of the draw member is angularly aligned with the anti-rotation feature of the assembly (step 310). Then, the drive portion 232 of the tensioning member 202 may be rotated until the anti-rotation features mate 126, 238 and the flange 216 contacts the other sideplate 106 (step 312), thereby tightening the mechanism 200. Alternatively, the second draw member may be inserted such that its anti-rotation feature mates the anti-rotation feature of the assembly or sideplate, and is then pushed in, causing the other draw member to protrude from the other side of the assembly or sideplate. Then, the mechanism may be tightened a previously described, causing the draw members to bring the sideplates toward the powercell and clamping onto the powercell. Disassembly may be performed by essentially reversing these various steps.

Figure 7:
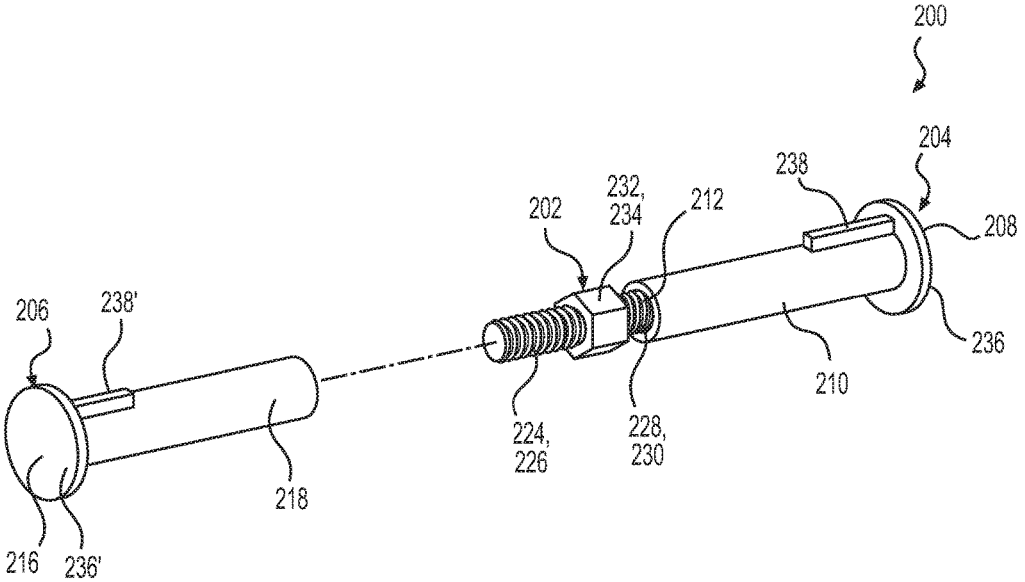
FIG. 7 is a partially exploded assembly view of the mechanism of FIG. 6, revealing the right handed threads of the left portion of the tensioning member of the mechanism.

Focusing now on FIGS. 6 and 7, the tightening mechanism 200 itself is shown in isolation from the hammer assembly 100. The tightening mechanism 200 can be seen to comprise a first draw member 204 including a flange 208 and a shaft 210 defining an aperture 212 including left handed internal threads 214 (shown in FIG. 5), a second draw member 206 including a flange 216 and a shaft 218 defining an aperture 220 including right handed internal threads 222 (shown in FIG. 5), and a tensioning member 202 including a first end portion 224 including right handed external threads 226, a second end portion 228 including left handed external threads 230 and a center drive portion 232 disposed between the first and second end portions 224, 228. For this embodiment, the drive portion 232 includes a hexagonal nut 234 integrally attached to the first and second end portions 224, 228. Other configurations are possible.

As mentioned previously, the flange 208 of the first draw member 204 and the flange 216 of the second draw member 206 may comprise flat plate portions 236, 236', which may minimize the risk of damaging these flanges for reasons explained earlier herein. Also, the first or second draw member 204, 206 may include an anti-rotation feature 238, 238'.

Looking at FIG. 6, the shaft 210 of the first draw member 204 defines a first aperture 212 and the left handed internal threads 214 are disposed in the first aperture 212 a first predetermined depth D214 and the left handed external threads 230 of the second end portion 228 of the tensioning member 202 extends a first predetermined distance D230 and the first predetermined depth D214 is greater than or equal to the first predetermined distance D230. Similarly, the shaft 218 of the second draw member 206 defines a second aperture 220 and the right handed internal threads 222 are disposed in the second aperture 220 a second predetermined depth D222 and the right handed external threads 226 of the second end portion 228 of the tensioning member 202 extends a second predetermined distance D226 and the second predetermined depth D222 is greater than or equal to the second predetermined distance D226.

In some, embodiments, the first and second distances D222, D 230 are equal and the first and second depths D214, D222 are equal. Also, the first and second draw members 204, 206 may define external geometry (not including the apertures or internal threads) that is identically configured.

INDUSTRIAL APPLICABILITY

In practice, a hammer assembly, a tightening mechanism, or a component thereof according to any embodiment described herein may be sold, manufactured, bought etc. and used to assemble such a mechanism or a hammer assembly. In particular, a method of using a mechanism to assemble a hammer assembly as just described will now be addressed.

It should be noted that the method of use, as will now be described with reference to FIG. 8, may be used in conjunction with or separately from the method of installation or assembly that was previously discussed with reference to FIG. 5 earlier herein.

Figure 8:
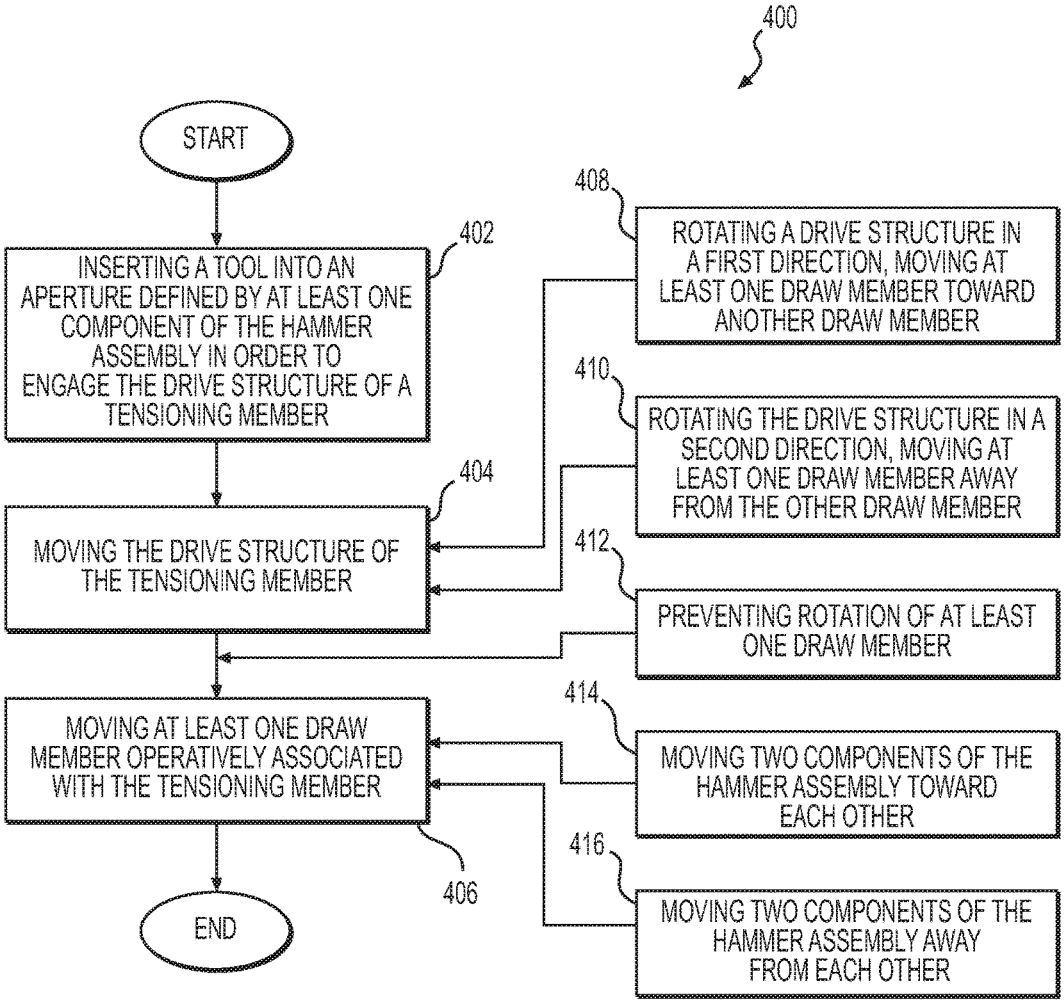
FIG. 8 is a flowchart depicting the steps of a method of using a tightening mechanism according to an embodiment of the present disclosure.

FIG. 8 is a flowchart showing the method of using various embodiments of the tightening mechanism. A method 400 for tightening or loosening components of a hammer assembly may comprise the following steps: inserting a tool into an aperture defined by at least one component of the hammer assembly in order to engage the drive structure of a tensioning member (step 402), moving the drive structure of the tensioning member (step 404), and moving at least one draw member operatively associated with the tensioning member (step 406).

In some embodiments, the step of moving the drive structure may include rotating a drive structure in a first direction, moving at least one draw member toward another draw member (step 408). In such a case, the step of moving the drive structure may also include rotating the drive structure in a second direction, moving at least one draw member away from the other draw member (step 410).

In some cases, the method may further comprise preventing rotation of at least one draw member (step 412). Then, the method may include moving two components of the hammer assembly toward each other (step 414) or moving two components of the hammer assembly away from each other (step 416).

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, it is intended that the specification and examples be considered as exemplary only, with a true scope and spirit of the invention(s) being indicated by the following claims and their equivalents.

What is claimed is:

1. A hammer assembly comprising:

a first sideplate defining a first side aperture;

a second sideplate defining a second side aperture;

a powercell assembly disposed between the first sideplate and the second sideplate defining a bore extending through the assembly that is in communication with the first and second side apertures, the assembly also defining an access aperture that is in communication with the bore; and a tightening mechanism operationally associated with the first and second sideplates, said mechanism being configured to tighten or loosen the sideplates around the powercell, the mechanism being disposed in the bore of the powercell assembly;

wherein the tightening mechanism includes a first draw member, a second draw member and a tensioning member interfacing with the first draw member and the second draw member;

the first draw member includes a flange and a shaft defining a first aperture and including left handed internal threads disposed in the first aperture, the second draw member includes a flange and a shaft defining a second aperture and including right handed internal threads disposed in the second aperture, and the tensioning member includes a first end portion including right handed external threads mating with the right handed internal threads of the second aperture of the shaft of the second draw member, a second end portion including left handed external threads mating with the left handed internal threads of the first aperture of the first draw member, and a center drive portion disposed between the first and second end portions being positioned in the access aperture; and the flange of the first draw member and the flange of the second draw member are flat plate portions and at least one of the first side aperture and second side aperture define a first anti-rotation feature and at least one of the flange of the first draw member, the flange of the second draw member, the shaft of the first draw member and the shaft of the second draw member includes a second anti-rotation feature mating with the first anti-rotation feature, the first anti-rotation feature being a keyway and the second anti-rotation feature being a key extending from the flange of the first draw member or the flange of the second draw member.

2. The hammer assembly of claim 1 wherein the center drive portion includes a hexagonal drive structure.

3. The hammer assembly of claim 1 wherein the first end portion, the center drive portion and the second end portion are integrally formed as part of a single component, and the first sideplate and the second sideplate define a slot therebetween, and the center drive portion is disposed in the slot, and the flange of the first draw member defines an enclosed end for the first draw member and the flange of the second draw member defines an enclosed end for the second draw member.

4. The hammer assembly of claim 3 wherein the first draw member and second draw member are identically externally configured.

* * * * *